US005966750A

United States Patent [19]

Polanco

[11] Patent Number: 5,966,750

[45] Date of Patent: Oct. 19, 1999

[54] CHAIR FOR WASHING DISABLED INDIVIDUALS

[76] Inventor: Margaret Polanco, P.O. Box 22, Gila, N.Mex. 88038

[21] Appl. No.: 09/026,821

[22] Filed: Feb. 20, 1998

[51] Int. Cl.[6] ..... A47K 11/06

[52] U.S. Cl. ..... 4/480; 297/DIG. 4

[58] Field of Search ..... 4/480, 483, 560.1, 4/561.1, 562.1, 604, 237; 297/DIG. 4

[56] References Cited

U.S. PATENT DOCUMENTS

| | | | |
|---|---|---|---|
| 2,673,987 | 4/1954 | Upshaw et al. | 297/DIG. 4 X |
| 4,091,479 | 5/1978 | Hancock | 4/185 |
| 4,150,445 | 4/1979 | Bailey | 4/560.1 X |
| 4,229,039 | 10/1980 | Day | 4/480 X |
| 4,287,619 | 9/1981 | Brewer et al. | 4/483 |
| 4,600,239 | 7/1986 | Gerstein et al. | 297/349 |
| 4,785,483 | 11/1988 | Wise | 4/483 X |
| 5,068,930 | 12/1991 | Ruggiero | 4/560 |
| 5,329,651 | 7/1994 | Mardero et al. | 4/605 |
| 5,347,662 | 9/1994 | Carper-White | 4/237 |
| 5,373,591 | 12/1994 | Myers | 4/560 |
| 5,517,704 | 5/1996 | Dagostino | 4/560.1 |
| 5,606,751 | 3/1997 | Baker | 4/560.1 |

*Primary Examiner*—Charles E. Phillips
*Attorney, Agent, or Firm*—Antonio R. Durando

[57] ABSTRACT

A chair for washing disabled individuals has wheels as well as a pair of handles for guiding the chair. The wheels are provided with locking mechanisms, and shields which prevent dirt and scum from depositing on the wheels. The chair is equipped with a rotatable seat which allows a caregiver to swivel a disabled individual, and with a retractable seat belt for restraining a disabled individual. The seat can be locked in any of a multiplicity of positions. The chair is further equipped with two armrests and a footrest which can be pivoted out of the way of a caregiver.

6 Claims, 3 Drawing Sheets

CHAIR FOR WASHING DISABLED INDIVIDUALS

BACKGROUND OF THE INVENTION

1. Field of the Invention

The invention relates to an appliance for manipulating individuals.

2. Description of the Prior Art

One of the most difficult tasks facing caregivers for disabled individuals is washing the individuals. Currently, a disabled individual is transported to a shower stall or bathtub in a wheelchair where the individual is transferred to a bench or other support for washing. The transfer is a strain on the caregiver who must hold and physically move the disabled individual. The effort to transfer the disabled individual increases when, as is often the case, the disabled individual is a dead weight. Furthermore, the transfer of a disabled individual from a wheelchair to a bench or other support carries with it the risk of injury to the disabled individual and/or the caregiver.

When a disabled individual is unable to wash her/himself, the caregiver must perform this task also. The proper washing of a disabled individual is not a simple matter because the disabled individual must be moved to gain access to different parts of the body. Moreover, the caregiver must frequently use one hand to provide support for the disabled individual leaving only one hand free for the washing procedure.

Once the disabled individual has been washed, the disabled individual must be transferred from the bench or other support back to the wheelchair. This transfer again gives rise to the problems outlined above.

SUMMARY OF THE INVENTION

It is an object of the invention to provide an appliance which can simplify washing of a disabled individual.

Another object of the invention is to provide a method which allows washing of a disabled individual to be performed more easily.

The preceding objects, as well as others which will become apparent as the description proceeds, are achieved by the invention.

One aspect of the invention resides in an appliance for manipulating an individual. The appliance comprises a support, rolling elements mounting the support for movement, and a seat mounted for rotation on the support. The appliance further comprises means for securing an individual on the seat to the support, and the securing means includes an extendable and retractable securing element.

The rolling elements of the appliance in accordance with the invention permit the appliance to be wheeled into a shower enclosure. An individual seated on the appliance need not be transferred from the appliance for washing since the rotatable seat enables a caregiver to readily turn the individual in order to access different parts of the body. The securing means allows the individual to be held in the appliance without assistance from the caregiver thereby freeing both hands of the caregiver for the washing procedure. By designing the securing means with a securing element which can be extended and retracted, it becomes possible to retract the securing element when the individual is to be turned or removed from the appliance. The securing element is preferably retractable in such a manner that the securing element will not hinder turning of the individual or removal of the individual from the appliance, and will not pose a danger to the individual or the caregiver.

Another aspect of the invention resides in a method of cleaning an individual. The method comprises the steps of seating the individual on a rotatable seat, wheeling the individual into a washing enclosure while the individual remains on the seat, and washing a first part of the individual in the enclosure while the individual remains on the seat. The method further comprises the steps of rotating the seat and the individual in the enclosure while the individual remains on the seat, washing a second part of the individual in the enclosure while the individual remains on the seat, and wheeling the individual out of the enclosure while the individual remains on the seat.

The method may additionally comprise the step of securing the individual on the seat. The securing step may involve withdrawing a securing element from a housing, and passing the securing element at least partly around the individual.

The method can also comprise the steps of placing a foot of the individual on a footrest which is in an extended position, removing the foot from the footrest, and pivoting the footrest to a retracted position. The retracted position of the footrest is advantageously such that the footrest will not interfere with removal of the individual from the seat and will not pose a hazard to a caregiver.

The method may further include placing an armrest in an extended position for use by the individual, and pivoting the armrest to a retracted position. It is preferred for the armrest to be so situated in the retracted position thereof that the armrest is not a hindrance to turning or washing of the individual, or to removal of the individual from the seat.

The method can additionally comprise the steps of fixing the seat against rotation, prior to washing the first part of the individual, with the individual in a first position, and releasing the seat subsequent to washing the first part of the individual and before rotating the seat. The method can also comprise the step of fixing the seat against rotation, after rotating the seat and before washing the second part of the individual, with the individual in a second position.

Additional features and advantages of the invention will be forthcoming from the following detailed description of preferred embodiments when read in conjunction with the accompanying drawings.

DESCRIPTION OF THE PREFERRED EMBODIMENTS

Figure 1:
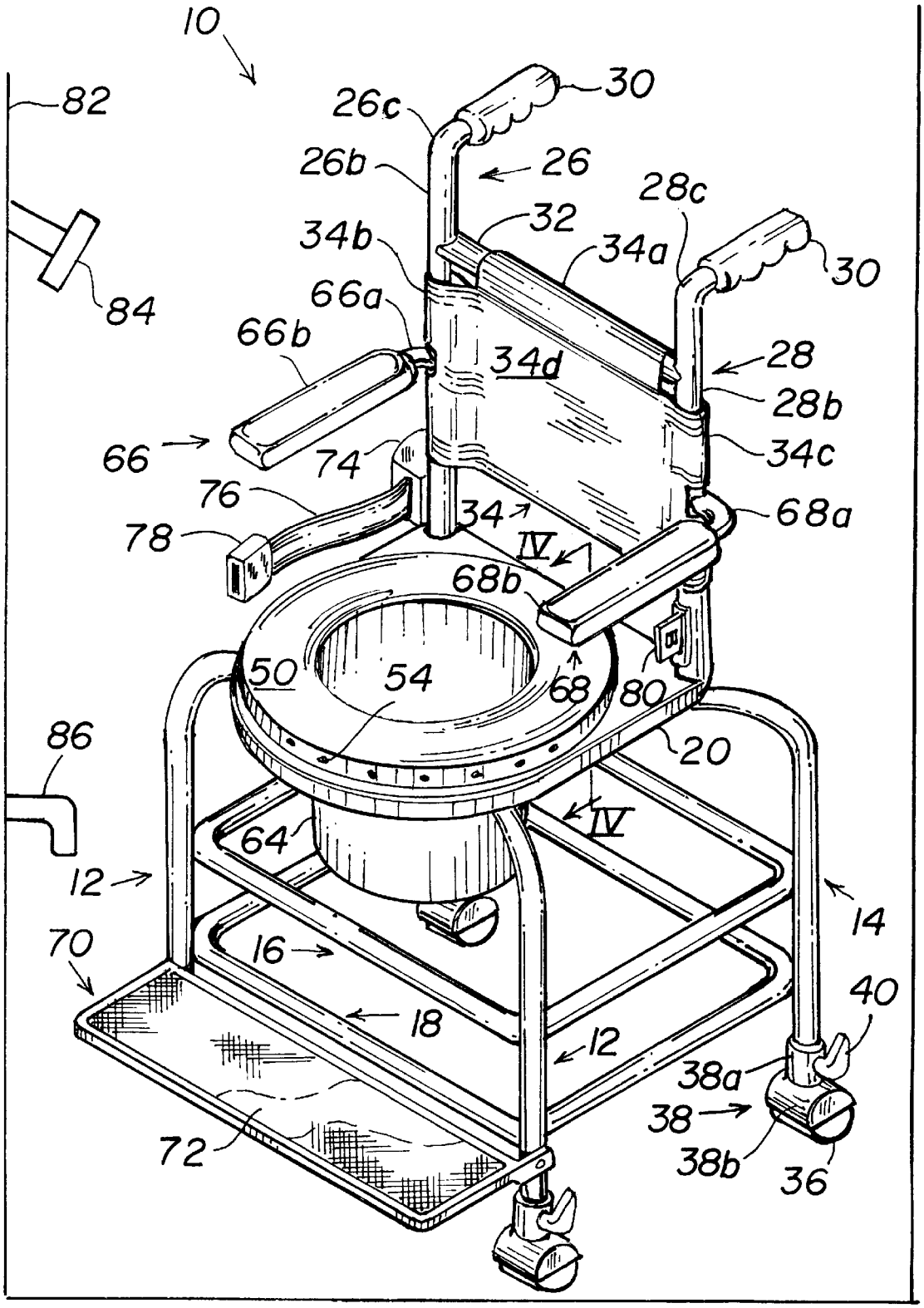
FIG. 1 is a perspective view of an appliance in accordance with the invention.
Figure 2:
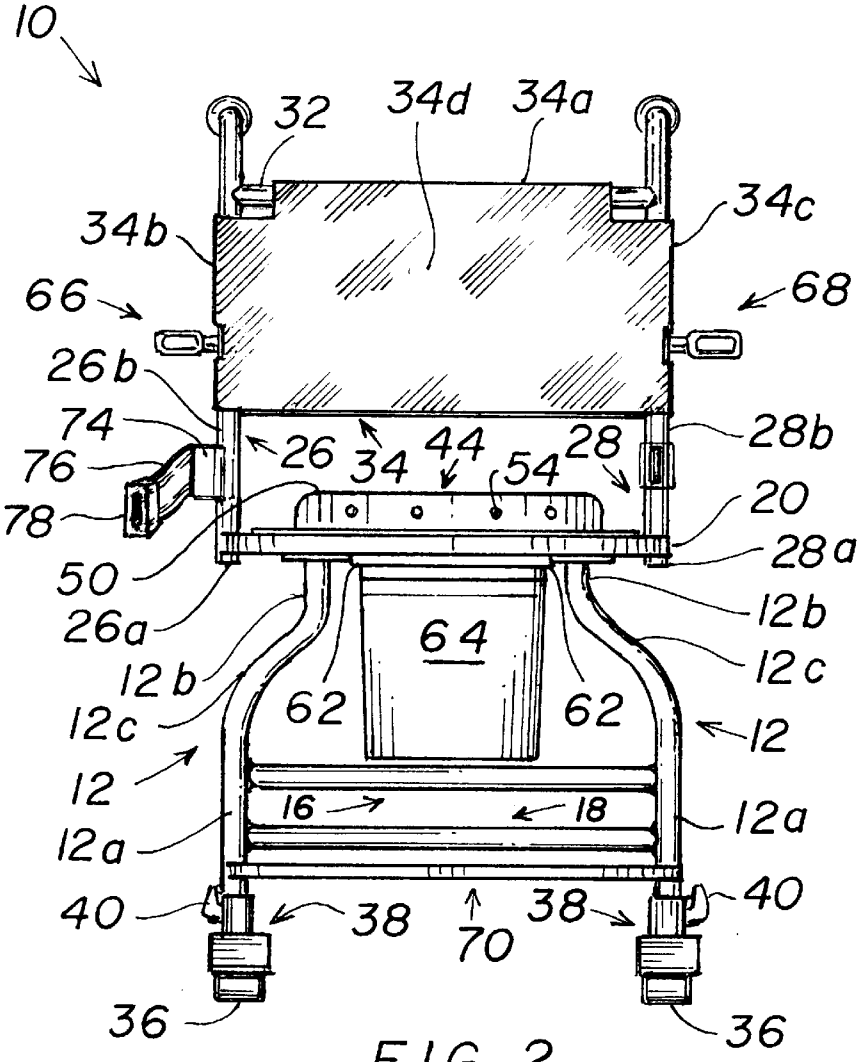
FIG. 2 is a front view of the appliance.

FIGS. 1 and 2 illustrate an appliance according to the invention. The appliance is in the form of a chair 10 which can be used to manipulate individuals, especially disabled individuals. Disabled individuals include individuals who are permanently non-ambulatory due to a lasting physical handicap and individuals who have been rendered temporarily non-ambulatory by an accident, medical procedure or other event. The chair 10 is particularly well-adapted for washing such individuals.

The chair 10 comprises a carrier or support having a pair of front legs 12 and a pair of rear legs 14 designed for high strength. Considering FIGS. 2 and 3, each of the front legs 12 has a generally vertical lower portion 12*a*, a generally vertical upper portion 12*b* which is horizontally offset relative to the respective lower portion 12*a*, and a bent intermediate portion 12*c* between the upper and lower portions 12*a*,12*b*. Similarly, each of the rear legs 14 has a generally vertical lower portion 14*a*, a generally vertical upper portion 14*b* which is horizontally offset relative to the respective lower portion 14*a*, and a bent intermediate portion 14*c* between the upper and lower portions 14*a*,14*b*. Preferably, the lower ends of the legs 12,14 lie at the corners of a square while the upper ends of the legs 12,14 lie at the corners of a smaller square.

The legs 12,14 are braced by two spaced horizontal reinforcing members 16 and 18 disposed one above the other. The reinforcing members 16,18 have four sides as illustrated in FIG. 1, and one side of each reinforcing member 16,18 spans the front legs 12 while a second side of each reinforcing member 16,18 spans the rear legs 14. A third side of each reinforcing member 16,18 spans the front leg 12 and rear leg 14 on one side of the carrier whereas the fourth side of each reinforcing member 16,18 spans the front leg 12 and rear leg 14 on the opposite side of the carrier.

Figure 4:
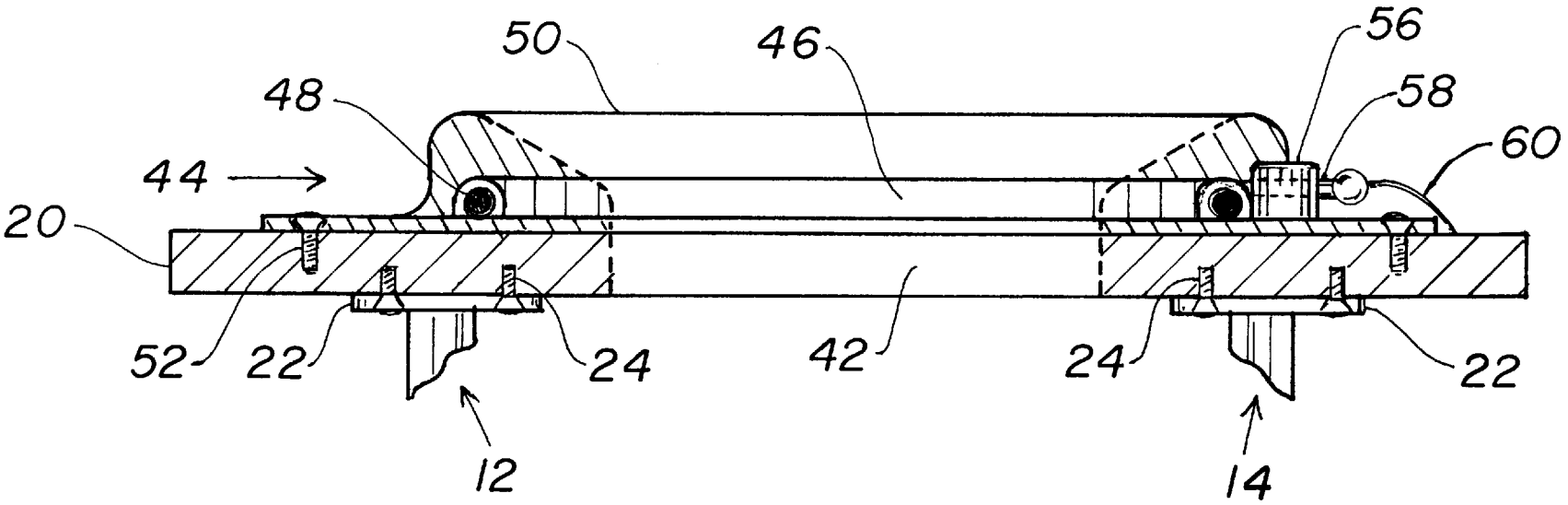
FIG. 4 is a sectional view, as seen in the direction of the arrows IV—IV of FIG. 1, of a seat assembly forming part of the appliance.

The carrier of the chair 10 further includes a platform or base 20 which sits on top of the legs 12,14. As best seen in FIG. 4, the upper ends of the legs 12,14 are provided with flanges 22 which are attached to the platform 20 by suitable fasteners 24.

The carrier of the chair 10 additionally includes two parallel rear members 26 and 28 which are disposed at opposite sides of the chair 10. The rear member 26 has a lower horizontal portion 26*a* (FIG. 2) which is located underneath and is fastened to the platform 20, a vertical or almost vertical portion 26*b* which extends upward from the rear end of the horizontal portion 26*a* behind the platform 20, and an upper horizontal portion 26*c*. The upper horizontal portion 26*c* extends rearward from the upper end of the vertical portion 26*b* and defines a handle. Like the rear member 26, the rear member 28 has a lower horizontal portion 28*a* (FIG. 2) which is located underneath and is fastened to the platform 20, a vertical or almost vertical portion 28*b* which extends upward from the rear end of the horizontal portion 28*a* behind the platform 20, and an upper horizontal portion 28*c*. The upper horizontal portion 28*c* extends rearward from the upper end of the vertical portion 28*b* and again defines a handle. A plastic or rubber grip 30 (FIG. 1) is mounted on each of the handles 26*c*,28*c*.

Considering FIG. 1, the rear members 26,28 are braced by a horizontal reinforcing member 32. A back member 34 is supported on the rear members 26,28 and the reinforcing member 32. The back member 34 comprises an elongated loop 34*a* which passes around the reinforcing member 32, an elongated loop 34*b* which passes around the vertical portion 26*b* of the rear member 26 and an elongated loop 34*c* which passes around the vertical portion 28*b* of the rear member 28. The back member 34 further comprises a flat panel 34*d* which bridges the loops 34*b*,34*c* and extends downward from the loop 34*a*. The vertical portions 26*b*,28*b* of the rear members 26,28 cooperate with the bracing member 32 and the back member 34 to define a backrest. The backrest 34 is preferably removable for cleaning.

A sealed, self-lubricated caster or rolling element 36 is mounted on the lower end of each leg 12,14. The casters 36, which are of heavy duty construction, are protected from above by shielding or covering members 38. As best seen in FIG. 1, the shielding members 38 include tubular elements or sections 38*a* which fit on the respective legs 12,14 and semicircular housings or shells 38*b* which receive the upper parts of the respective casters 36. Each of the shielding members 38 carries a locking mechanism 40 which allows the respective caster to be locked or braked.

The platform 20 is provided with an opening 42 (FIG. 4). An annular seat assembly 44 mounted on top of the platform 20 runs around the opening 42 and has a central opening in register therewith. The seat assembly 44 includes an annular track or guide 46 for ball bearings 48 (FIG. 4), and an annular seat 50 which is supported for rotational or swiveling movement on the ball bearings 48. The track 46 is fastened to the platform 20 by fasteners 52, and the ball bearings 48 are sealed inside the seat assembly 44 which is self-lubricated. The ball bearings 48 can, for example, consist of Teflon (trademark).

Figure 3:
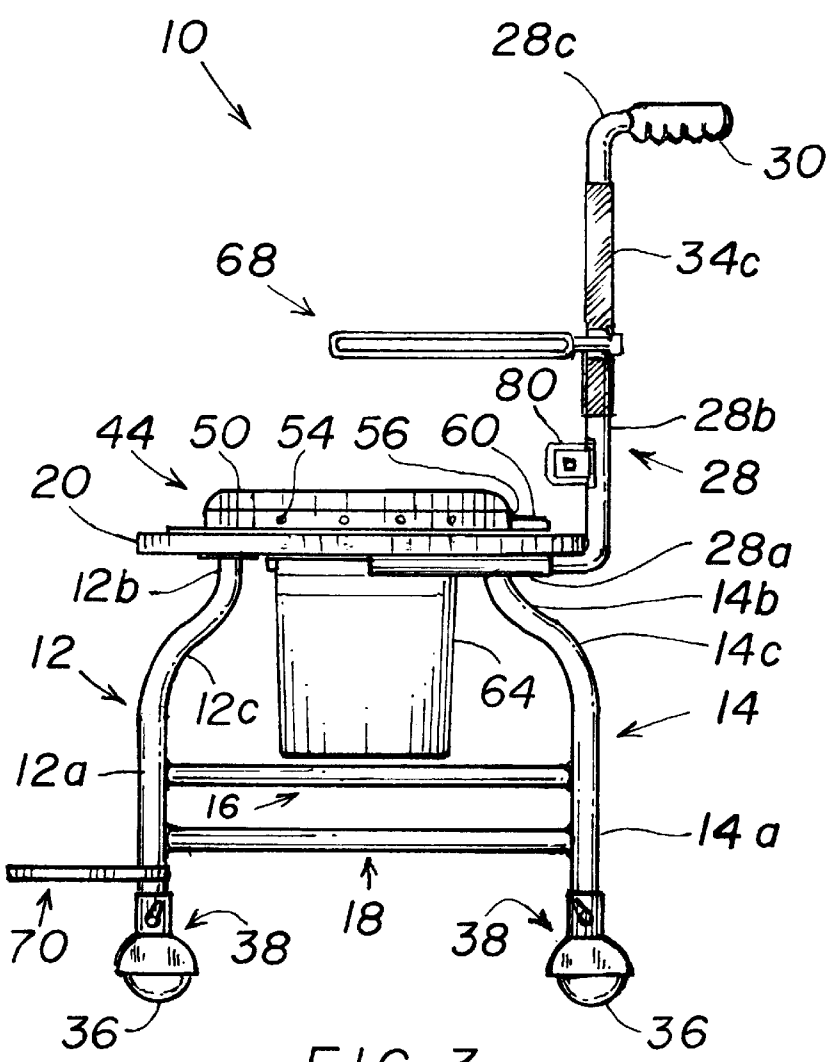
FIG. 3 is a side view of the appliance.

The seat 50 has an outer peripheral surface which extends circumferentially of the seat 50, and such surface is provided with a series of relatively closely spaced apertures 54. The apertures 54 are arranged on an annulus which circumscribes the opening 42 in the platform 20. With reference to FIGS. 3 and 4, a short upright shaft or column 56 is mounted at the rear of the platform 20 adjacent the seat 50. The shaft 56 is formed with a horizontal passage which is located at the same level as, and is normal to the annulus of, the apertures 54. A locking pin 58 is secured to the rear of the platform 20 by a flexible cable or element 60 and fits in the passage as well as in the apertures 54. When the passage is in register with one of the apertures 54, the locking pin 58 can be inserted in the passage and in the registering aperture 54 to lock the seat 50 against rotation.

FIG. 2 shows that a pair of elongated brackets 62 is mounted on the underside of the platform 20. The brackets 62, which run in a direction from the front to the rear of the chair 10, are located on opposite sides of the opening 42 in the platform 20. Each of the brackets 62 has a vertical arm which extends downward from the platform 20 and a horizontal arm at the end of the vertical arm remote from the platform 20. The horizontal arms extend parallel to one another, and each of the horizontal arms cooperates with the platform 20 to define a horizontal guide slot running in a direction from the front to the rear of the chair 10.

A chamber pot or catch vessel 64 is suspended from the brackets 62 by way of an annular flange which extends circumferentially of the chamber pot 64 at the upper end thereof. The flange is slidable in the slots defined by the brackets 62 and the platform 20, and the slots are designed so that the chamber pot 64 can be slid into and out of the chair 10 from the rear. The upper end of the chamber pot 64 has an opening which can be brought into alignment with the opening 42 in the platform 20 and the opening in the seat assembly 44.

An armrest 66 is mounted on the vertical portion 26*b* of the rear member 26. Considering FIG. 1, the armrest 66 comprises a right-angled carrying member 66*a* having a first leg which extends into the vertical portion 26*b* through an aperture in the loop 34*b* of the back member 34. This leg, which runs sideways, is pivotally supported on the vertical portion 26*b*. The carrying member 66*a* has a second leg at the end of the first leg remote from the vertical portion 26*b*, and the second leg extends from the first leg towards the front of the chair 10. The second leg supports an elongated padded element 66*b* on which an individual in the chair 10 can rest her or his right arm.

A second armrest 68 is mounted on the vertical portion 28*b* of the rear member 28. Like the armrest 66, the armrest 68 comprises a right-angled carrying member 68*a* having a first leg which extends into the vertical portion 28*b* through an aperture in the loop 34*c* of the back member 34. This first leg again runs sideways and is pivotally supported on the vertical portion 28*b*. The carrying member 68*a* has a second leg at the end of the first leg remote from the vertical portion 28*b*, and the second leg extends from the first leg towards the front of the chair 10. The second leg supports an elongated padded element 68*b* on which an individual in the chair 10 can rest her or his left arm.

In FIGS. 1–3, the armrests 66,68 are in extended or operative positions in which the padded elements 66*b*,68*b* are horizontal. The armrests 66,68 can be pivoted upward from the extended positions to retracted or inoperative positions in which the armrests 66,68 do not interfere with the turning or washing of a disabled individual, or with the removal of the individual from the chair 10. For instance, the retracted positions can be ones in which the padded elements 66*b*,68*b* are vertical and are situated next to the vertical portions 26*b*,28*b* of the rear members 26,28.

A footrest 70 is mounted on the front legs 12 of the chair 10. The footrest 70 is pivotable between the extended or operative position illustrated in FIGS. 1–3 and a retracted or inoperative position in which the footrest 70 neither hinders removal of a disabled individual from the chair 10 nor poses a hazard to a caregiver. The footrest 70 is horizontal in the extended position and is swung upward when the footrest 70 is to be placed in the retracted position. The footrest 70 may be generally vertical in the retracted position and can bear against the front legs 12 in such position. Advantageously, the footrest 70 is designed to lock in the retracted position.

The footrest 70 has a bearing surface which faces upward in the extended position and is designed to support the feet of an individual in the chair 10. The bearing surface is preferably provided with a nonslip covering or coating 72 (FIG. 1).

A housing 74 is mounted below the armrest 66 on the vertical portion 26*b* of the rear member 26. The housing 74 is designed to accommodate an elongated flexible securing element 76 which is here in the form of a strap or seat belt. The strap 76 has a free end externally of the housing 74, and the free end of the strap 76 carries a buckle 78. The other end of the strap 76 is secured to a reel internally of the housing 74. The reel allows the strap 76 to be retracted into the housing 74 and withdrawn therefrom, that is, the strap 76 is retractable and extendable. The strap 76 is preferably padded, e.g., with a foamed material, at least on that side thereof which faces an individual in the chair 10.

A latch 80 is fixed to the vertical portion 28*b* of the rear member 28 at the same height as the strap housing 74. The latch 80 is receivable by the buckle 78 which can grip the latch 80 to prevent retraction of the strap 76 into the housing 74.

The buckle 78 and latch 80 can be replaced by a hook-and-loop fastener, e.g., Velcro (trademark).

The chair 10, including all fasteners, is advantageously constructed of corrosion-resistant materials. By way of example, the legs 12,14, reinforcing members 16,18, platform 20, rear members 26,28, bracing member 32, carrying members 66*a*,68*a*, buckle 78 and latch 80 can be made of aluminum, galvanized steel or stainless steel. These materials, as well as plastic, can be employed for the casters 36, shielding members 38, locking mechanisms 40, seat assembly 44, chamber pot 64, footrest 70 and strap housing 74. It is preferred for the ball bearings 48 of the seat assembly 44 to consist of Teflon (trademark). The back member 34 may be composed of nylon or Herculite (trademark), e.g., Herculite 80 (trademark), while the strap 76 may consist of nylon or Herculite (trademark) in combination with a foamed material. The padded elements 66*b*,68*b* can be made from a foamed material and plastic.

It is of advantage for the legs 12,14, reinforcing members 16,18, rear members 26,28, bracing member 32 and carrying members 66*a*,68*a* to be constructed of tubing. This enables the weight of the chair 10 to be reduced.

One mode of operation of the chair 10 will be described assuming that a caregiver is to wash a disabled individual who is in a bed or wheelchair.

The caregiver wheels the chair 10 to the disabled individual. At this time, the seat 50 is locked against rotation by the locking pin 58 and the strap 76 is retracted.

When the caregiver arrives with the chair 10, the caregiver locks the casters 36 with the respective locking mechanisms 40. If the armrests 66,68 and the footrest 70 are in their extended positions, the caregiver pivots the footrest 70 and the armrests 66,68 to the retracted positions.

The caregiver now transfers the disabled individual from the bed or wheelchair into the chair 10. Once the disabled individual has been seated, the caregiver withdraws the strap 76 from the strap housing 74, passes the strap 76 around the individual and snaps the buckle 78 over the latch 80 to secure the individual in the chair 10. The caregiver additionally pivots the footrest 70 and the armrests 66,68 to their extended positions and places the feet of the individual on the footrest 70. The caregiver thereupon releases the locking mechanisms 40 for the casters 36, grasps the grips 30 on the handles 26*c*,28*c* and wheels the chair 10 with the disabled individual into a washing or showering enclosure 82. The washing enclosure 82 is here equipped with a shower head 84 as well as a faucet 86.

In the washing enclosure 82, the caregiver again locks the casters 36 with the locking mechanisms 40. The disabled individual remains seated on the chair 10 while the caregiver disrobes the individual. Should the strap 76, the armrest 66, the armrest 68 and/or the footrest 70 hamper this procedure, the caregiver releases the strap 76 and/or pivots the armrest 66, the armrest 68 or the footrest 70 to its retracted position. After the disabled individual has been disrobed, the caregiver rebuckles the strap 76 and/or pivots the armrest 66, the armrest 68 or the footrest 70 to its extended position.

The caregiver thereupon begins washing the disabled individual with a sponge or washcloth. Since the individual is strapped in the chair 10 and does not require support from the caregiver, the latter has both hands free for the washing procedure. Should the armrest 66, the armrest 68 or the footrest 70 interfere with washing of the disabled individual, the caregiver retracts the armrest 66, the armrest 68 or the footrest 70 as long as necessary.

The disabled individual initially sits facing to the front of the chair 10 with her or his back against the backrest 34. In this position, the caregiver can wash the front and sides, as well as the arms and legs, of the individual. However, at least part of the back is not readily accessible to the caregiver. Thus, when the caregiver has finished washing the front, the sides, the arms and the legs of the disabled individual, the caregiver moves the armrests 66,68 to their retracted positions, releases the strap 76 and removes the locking pin 58 from the seat 50. The caregiver now rotates the seat 50 together with the disabled individual so that the individual faces to one side of the chair 10 with the back of the individual exposed. The locking pin 58 is reinserted in the seat 50, the strap 76 is rebuckled and the caregiver proceeds to wash the back of the disabled individual.

Once the back has been washed, the caregiver dries the back, the front and the legs of the disabled individual as well as the arm and the side which face towards the front of the chair 10. The caregiver then releases the strap 76, removes the locking pin 58 from the seat 50 and swivels the latter together with the disabled individual so that the individual again faces to the front of the chair 10. The locking pin 58 is reinserted in the seat 50, the strap 76 is rebuckled and the caregiver finishes drying the disabled individual.

After the disabled individual has been dried, the caregiver places a robe or other garment on the individual. Should the strap 76, the armrest 66, the armrest 68 and/or the footrest 70 interfere with this procedure, the caregiver releases the strap 76 and/or pivots the armrest 66, the armrest 68 or the footrest 70 to its retracted position. When the robe or other garment has been placed on the disabled individual, the caregiver rebuckles the strap 76 and/or pivots the armrest 66, the armrest 68 or the footrest 70 to its extended position. The caregiver thereupon releases the locking mechanisms 40 for the casters 36, grasps the grips 30 on the handles 26*c*,28*c* and wheels the chair 10 with the disabled individual out of the enclosure 82 to a bed or wheelchair. Upon arrival, the caregiver locks the casters 36, pivots the armrests 66,68 and the footrest 70 to their retracted positions, releases the strap 76 and transfers the disabled individual to the bed or wheelchair.

The disabled individual remains in the chair 10 while the latter is wheeled into the enclosure 82 and while the individual is disrobed, washed and dried in the enclosure 82. The disabled individual further remains in the chair 10 while a robe or other garment is placed on the individual after drying and while the chair 10 is wheeled out of the enclosure 82.

If the caregiver finds it necessary to reposition the chair 10 when disrobing, washing or drying the disabled individual, or when placing a robe or other garment on the individual, the caregiver releases the locking mechanisms 40, moves the chair 10 and relocks the locking mechanisms 40.

Should the disabled individual inadvertently urinate or defecate while on the chair 10, the excretions will be caught by the chamber pot 64. The caregiver then slides the chamber pot 64 from the chair 10, disposes of the contents of the chamber pot 64, and slides the latter back onto the chair 10.

The chair 10 allows a caregiver to transport a disabled individual into and out of a washing or showering enclosure while maintaining control of the individual. The chair 10 further allows a caregiver to wash a disabled individual without assistance and eliminates the need for transferring the individual to the shower bench traditionally used for washing.

The rotatable seat 50 makes it possible for a caregiver to easily gain access to parts of the body which are normally difficult to reach. The apertures 54, in conjunction with the locking pin 58, enable the seat 50 to be fixed in a multiplicity of different positions so that a caregiver can position a disabled individual in a manner convenient for the caregiver.

The strap 76 enables a disabled individual to be restrained thereby freeing both hands of a caregiver for washing the individual. By making the strap 76 retractable into the housing 74, the strap 76 can be stored in the housing 74 when not in use so that it does not get in the way of a caregiver and does not pose a danger to the caregiver or to a disabled individual being handled by the caregiver.

The pivotable design of the armrests 66,68 enables the armrests 66,68 to be swung out of the way when a disabled individual is placed on or removed from the chair 10, when a disabled individual is swiveled on the seat 50, and when the armrests 66,68 hinder washing of a disabled individual. Similarly, the pivotable design of the footrest 70 permits the latter to be rotated to a position in which the footrest 70 does not interfere with the placement of a disabled individual on the chair 10, with the removal of a disabled individual from the chair 10, and with washing of a disabled individual.

The locking mechanisms 40 for the casters 36 allow a caregiver to anchor the chair 10 while a disabled individual is transferred to or from the chair 10 and while a disabled individual is being washed. The shielding members 38 for the casters 36 inhibit the deposition of dirt and scum on the casters 36.

The chamber pot 64 prevents soiling of the floor in the event that a disabled individual on the chair 10 inadvertently urinates or defecates. By designing the chamber pot 64 to be slidable onto and off the chair 10, a caregiver can readily empty the chamber pot 64 when necessary.

Various modifications are possible within the meaning and range of equivalence of the appended claims.

I claim:

1. An appliance for manipulating an individual comprising:

a support having a seating section, a back section protecting above said seating section, and a bottom section projecting below said seating section to hold said seating section;

rolling elements mounting said support for movement, said support being provided with handles which project rearward of said back section to maneuver said support, and said support being rollable by hand by pushing or pulling on said handles;

means for locking at least one of said rolling elements against rotation;

a seat mounted for rotation on said seating section, said seat and said seating section having registering openings;

a chamber pot on said support below said seat, said chamber pot having an open end in register with said registering openings, and said chamber pot being removable from said support by sliding said chamber pot along said support;

means for locking said seat against rotation in a plurality of different positions;

a footrest on said bottom section movable between an extended position and a retracted position, said footrest being generally horizontal in said extended position, and said footrest projecting forward of said support by a first distance in said extended position and by at most a smaller second distance in said retracted position;

an armrest on said support movable between an extended position and a retracted position, said armrest being generally horizontal in said extended position, and said armrest being located alongside and at a level above said seat in said extended position; and means for securing an individual on said seat to said support, said securing means including an extendable and retractable securing element, and said support being provided with a housing for said securing element, at least the major part of said securing element being retractable into said housing.

2. The appliance of claim 1, further comprising means for at least partly shielding one of said rolling elements.

3. The appliance of claim 2, wherein said one rolling element has an upper part and said shielding means comprises a housing which receives said upper part.

4. The appliance of claim 1, wherein said securing element comprises a flexible strap.

5. The appliance of claim 1, wherein said footrest has a nonslip surface portion.

6. The appliance of claim 1, wherein said armrest is padded.

* * * * *